United States Patent [19]

Garcia

[11] 4,372,137

[45] * Feb. 8, 1983

[54] LOCK

[75] Inventor: Francisco E. Garcia, Madrid, Spain

[73] Assignee: Patentes FAC, S.A., Madrid, Spain

[ * ] Notice: The portion of the term of this patent subsequent to Oct. 7, 1999, has been disclaimed.

[21] Appl. No.: 171,118

[22] Filed: Jul. 22, 1980

Related U.S. Application Data

[63] Continuation-in-part of Ser. No. 930,511, Aug. 3, 1978, Pat. No. 4,226,099.

[51] Int. Cl.[3] ..... E05B 67/08

[52] U.S. Cl. ..... 70/41; 70/43; 70/52; 70/53

[58] Field of Search ..... 70/14, 15, 16, 17, 18, 70/19, 32, 33, 34, 41, 45, 47

[56] References Cited

U.S. PATENT DOCUMENTS 1,371,691 3/1921 Pinker ..... 70/18

4,226,099 10/1980 Garcia ..... 70/41

*Primary Examiner*—Robert L. Wolfe

[57] ABSTRACT

A lock of the type preferably used with sliding doors having first and second elements constituted by solid cast material, the first element having a head disposed at one end thereof with a recess and a cavity therein. The second element is rotatably mounted at one end thereof to the first element such that the other end of the second element may be rotated into and out of the recess in the head of the first element. The second element also has a cavity therein which aligns with the cavity of the first element when the lock is closed. The cavity in the second element has a channel located in a wall of the cavity. A locking element is movably disposed in the cavity of the first element and is movable into and out of engagement with the cavity of the second element. The locking element has a locking device disposed offset from the geometric center, and preferably eccentrically, of the locking element. The locking device has a radial arm movable into and out of engagement with the channel in the cavity of the second element when the locking element is moved or depressed into engagement with the cavity of the second element.

The cavities in the first and second elements are preferably cylindrically shaped and aligned when the lock is in its closed position. Preferably, the locking element is similarly cylindrically shaped and the second element is rotatably mounted on the shaft affixed to the first element.

3 Claims, 4 Drawing Figures

LOCK

BACKGROUND OF THE INVENTION

This application is a continuation-in-part of U.S. patent application No. 930,511, filed Aug. 3, 1978, now U.S. Pat. No. 4,226,099.

This invention is concerned with improvements to the lock which is the subject of the aforementioned U.S. Pat. No. 4,226,099. These improvements relate to a lock which offers additional advantages which respects to the security provided and its ease of manufacture.

The lock described in U.S. Pat. No. 4,226,099 is especially designed for sliding doors which have two units facing each other by their vertical edges, the edges thereof being secured to each other by the lock itself; however, the lock may also be used whenever two parts or elements are intended to be fastened to each other.

U.S. Pat. No. 4,226,099 is hereby incorporated by reference and the following description refers to FIGS. 1–10 of said patent. Basically, the lock according to the aforementioned U.S. patent is constituted by the association of two independent bodies 1,2, each of which is formed by a series of plates joined to each other by rivets, thus forming lengthened flat bodies of greater or lesser thickness, according to the number of small plates by which they are formed. The bodies 1,2 are connected to each other by a common shaft 5 which is fixed to one of the bodies 1 and the other body 2 is rotatably mounted on shaft 5. The rotatably mounted body 2 has a cylindrical cavity 8 on its inner wall on the end thereof opposite shaft 5. The cavity 8 has a channel 9 in a wall of the cavity, which follows a portion of its circular contour.

The fixed body 2 has a number of small plates 6 joined at the end of the fixed body adjacent cavity 8. The fixed body 1 and the number of small plates 6 also have a cylindrical cavity which faces cavity 8 in the rotatably mounted body 2 when the lock is in its closed position. An internal keyed element 11 is eccentrically mounted in a cylindrical locking element or body 10 which movably disposed in the cavity of the fixed body 1. The internal element 11 has a radial arm 12 operated by a key 13, which arm 12 engages the aforementioned channel 9 when (1) the cylindrical body 10 is moved along the facing cylindrical cavities into cavity 8 and (2) key 13 is operated. The arm 12 is disposed in a channel 14 located in body 10. By turning the key 13, the arm 12 of the internal element 11, since it is eccentrically mounted, emerges from channel 14 and engages channel 8, the padlock thereby being closed and locked.

In general, the foregoing description basically characterizes the padlock that is the subject of U.S. Pat. No. 4,226,099. The improvements described herein which constitute the subject of this continuation-in-part application provide an improved lock having unitary, cast bodies instead of the system of small plates riveted to each other. The casting technique used in manufacture is preferable according to the technique known as microfusion. With this system of manufacture the product can be made in all types of alloys; however, stainless steel is preferably used because of its strength, durability, etc.

Using unitary bodies offer the advantage that the general appearance of the lock will always be maintained. The lock is commonly used in open air and/or in bad weather, and if the lock is formed by small plates, the small plates may be attacked by unfavorable atmospheric agents and lose their original appearance. This does not occur with cast bodies.

Another feature of the lock consists of the fact that when the rotatably mounted or mobile element of the lock is situated facing the principal or fixed body in order to proceed to the introduction of the inner element and its locking, it is housed in a recess provided in the said principal or fixed body.

BRIEF DESCRIPTION OF THE DRAWINGS

The novel features believed characteristic of the invention are set forth in the appended claims. The invention itself, however, as well as the preferred mode of use, further objects and advantages thereof, will be best understood by reference to the following detailed description of an illustrative embodiment when read in conjunction with the accompanying drawings, wherein:

Figure 1:
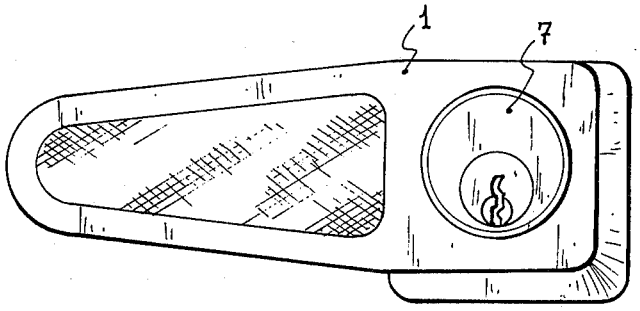
FIG. 1 is a plan view of the lock in its closed position.
Figure 2:
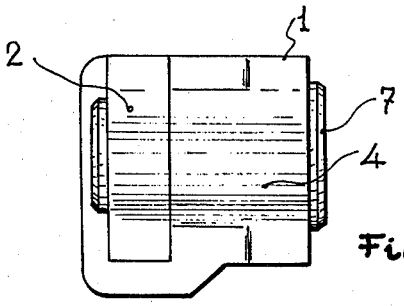
FIG. 2 is a side elevational view of the closed lock.

The following description refers to the accompanying figures and like reference numerals refer to the same element throughout these figures. The reader will observe that the reference numerals used in conjunction with the accompanying figures do not necessarily correspond to the reference numerals used in U.S. Pat. No. 4,226,009 which is incorporated into this patent by reference and to which reference has previously been made by reference numerals in the background portion hereof.

DETAILED DESCRIPTION OF AN ILLUSTRATIVE EMBODIMENT

Figure 3:
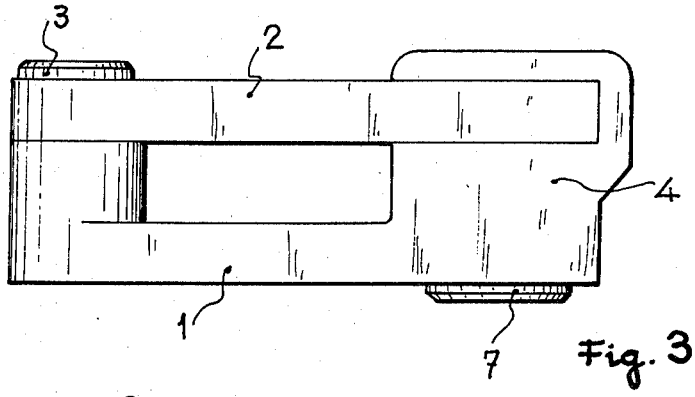
FIG. 3 is a top view of the closed lock.
Figure 4:
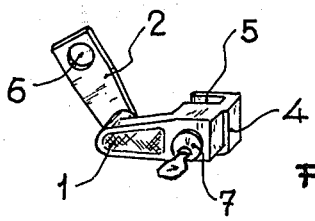
FIG. 4 is a general perspective view of the lock in its open position.

In the aforementioned figures it may be observed that the lock includes two elements 1 and 2 connected to each other at a shaft 3. Element 2 is completely flat solid case element while element 1 is U-shaped solid cast element, as can be clearly seen in FIG. 3. Shaft 3 is fixed to one of the ends of element 1, on which is rotatably mounted element 2 at one of the two ends thereof. Thus, the second element 2 rotates with respect to element 1 about fixed shaft 3.

The opposite end of the element 1 widens into a head 4 having a recess or opening 5 formed on its inner side facing shaft 3. The second element 2 has on its end opposite shaft 3 a cylindrical cavity 6 which is faces an inner locking element 7 in first element 1 when the lock is in its closed position. Inner element 7 is movably disposed in a transverse cavity in head 4 of the fixed element 1, which cavity aligns with cavity 6 when the lock is in its closed position. Inner element 7 may be depressed to enter and thus engage cavity 6 during the locking operation. The internal keyed element may then be operated to hold the depressed element 7 in place.

Both the inner or internal element 7 and its eccentrically disposed internal keyed element with radial arm used to effect the closure of the padlock are the same as those already described in U.S. Pat. No. 4,226,099 which is incorporated by reference and therefore these details need not be repeated here.

The lock so described is preferably used to join two units and to lock them to each other, such as the two units of a double sliding door, the units of scissor-type closures, etc., in such a way that the units to be joined to each other are housed in a space 8 established between the two elements 1 and 2. The rotation of element 2 with respect to element 1 permits either the freeing or locking of the two units to be joined and locked. Closure occurs when the end of element 2 is housed in recess 5 and inner element 7 is depressed and operated by the key. The end of inner element 7 then engages the cylindrical cavity 6 of element 2 temporarily locking elements 1 and 2 to each other. Inner element 7 is retained in this engaging position when the key is operated to engage the radial arm of inner element 7 in the channel in cavity 6.

Having described the invention in connection with a specific embodiment thereof, further modification may now suggest itself to those skilled in the art. It is to be understood that the invention is not limited to the specific embodiment disclosed, except as set forth in the appended claims.

What is claimed is:

1. A lock comprising:

(a) a first element constituted by solid cast material and comprised of a flat elongated base with a first leg and a second leg extending perpendicularly from the ends of said base, the first of said legs defining a recess and a cavity therein, said recess being parallel to said flat elongated base;

(b) a second element mounted parallel to said flat elongated base of said first element and being rotatably mounted on said second leg such that the other end of said second element may be rotated into and out of the recess in said first leg of said first element, said second element having a cavity therein, the cavity in said second element having a channel located in a wall thereof;

(c) a locking element movably disposed in the cavity of said first element and being movable into and out of engagement with the cavity of said second element, said locking element having a locking device disposed offset from the geometric center of said locking element, said locking device having a radial arm movable into and out of engagement with said channel in said cavity of said second element when said locking element is moved into engagement with said cavity of said second element.

2. The lock according to claim 1, wherein said cavities are cylindrically shaped, said locking element is likewise cylindrically shaped and said locking device is eccentrically disposed with respect to the cylindrical cavities and said locking element.

3. The lock according to claim 2, wherein said second element is rotatably mounted on a shaft affixed to said first element.

* * * * *